United States Patent [19]

Karlsson

[11] Patent Number: 4,482,156

[45] Date of Patent: Nov. 13, 1984

[54] TARGET DEVICE

[75] Inventor: Jörgen B. Karlsson, Huskvarna, Sweden

[73] Assignee: Saab Training Systems Aktiebolag, Huskvarna, Sweden

[21] Appl. No.: 560,137

[22] Filed: Dec. 12, 1983

[30] Foreign Application Priority Data

Dec. 13, 1982 [SE] Sweden ..... 8207104

[51] Int. Cl.[3] ..... F41J 7/00

[52] U.S. Cl. ..... 273/406

[58] Field of Search ..... 273/406

[56] References Cited

U.S. PATENT DOCUMENTS 4,330,129 5/1982 Meredith ..... 273/406 X

FOREIGN PATENT DOCUMENTS 1118015 6/1965 United Kingdom ..... 273/406

*Primary Examiner*—Paul E. Shapiro

*Attorney, Agent, or Firm*—James E. Nilles; James R. Custin

[57] ABSTRACT

The invention provides a target device comprising a board-like target member and a housing of low height that serves as a stand for supporting the target member in an upright position of use and encloses it when it is in a horizontal protected position with its front face down and its lower end near a rear wall of the housing. An elongated guiding device near the bottom of the housing, extending from near its front wall to near its rear wall, confines the lower end of the target board to back and forth motion. The front face of the target board at all times engages a sliding support on the front of the housing, spaced above the front end portion of the guiding device, so that back and forth movement of the lower end of the target board is attended by swinging of its upper end as it moves between its positions.

6 Claims, 3 Drawing Figures

TARGET DEVICE

The present invention relates to equipment for shooting ranges and specifically to a target device wherein a target board or a similar shooting target is movable between a protected position and a position of use in which it is exposed to be shot at; and the invention is more particularly concerned with a target device that comprises a low-profile housing that serves as a stand which supports the target board in its position of use and as a housing which fully encloses the target board in its protected position.

The conventional target devices for shooting ranges, especially those for firearms, are comprised of a board stand and elevator devices by which the target boards can be moved vertically from a protected position behind a protective wall or so-called butt, where the board stands are suspended, to a position of use in which the boards are free of the butt and exposed to be shot at. A shooting range with such board elevators entails very high construction costs, primarily because of the need for earthworks for the butt and the so-called marker pit where scorers can remain during firing. A further factor that increases costs is the target sheds that are usually provided at the protective wall, for storage of target boards.

For simulated combat field practice, a so-called fall target is often used, generally in the form of a cardboard figure that is swingable about a horizontal axis under the target and is remotely actuable between a horizontal position and a raised exposed position. Such a target device is not suitable for firearms ranges and the like where practice is held frequently and where target boards must be stored near the positions where they are used. A fall target requires a very high turning moment for erecting the board, and further, because of its movement geometry, it would be hard to arrange a protection over its board that would be operative in consequence of the board falling down. This lack of protection would be especially undesirable for those advanced target boards for automatic hit registration which have come forth in recent years and which have an easily damaged apparatus. For a firing range target device it is a desideratum that the target board be effectively protected in its rest position against wind, weather and mechanical damage.

The present invention has as its object to provide a target device which requires no expensive earthworks or superstructure for its installation in a shooting range and which makes possible an automatic movement of a target between a protected position and an exposed position. The device further affords protective storage for the target when it is not in use, so that the device can remain in place on the range at all times.

This object is achieved according to the invention in a target device of the type comprising a substantially boardlike target member having opposite front and rear faces and opposite upper and lower ends and wherein the target member is movable between a protected position and a position of use in which its front face is substantially upright and exposed to be shot at. The target device of this invention is characterized by means defining a housing having opposite front and rear walls and opposite side walls and wherein the target member can occupy a protected position between the side walls, extending substantially horizontally with its front face downward and its lower end near the rear wall. Elongated guide means fixed in the housing, near the bottom thereof, extends from near its rear wall to near its front wall and cooperates with slidable controlled means on the target member, near the lower end of it, to confine the lower end of the target member to backward and forward movement in the housing. The front face of the target member is at all times slidably engaged with sliding support means on the housing, adjacent to its front wall and at a level above the front end portion of the guiding means, which cooperates with the guiding means and the controlled means to constrain the target member to swing up to its position of use as its lower end is moved forward.

Preferably the housing has fixed means thereon defining an abutment which is spaced to the rear of the sliding support means and is at a level above the front end portion of the guiding means, against which the rear face of the target member is engaged when the target member is in its position of use and which cooperates with the sliding support means to hold the target member upright.

The target member can be moved between its said positions by actuator means in the housing, connected with the controlled means to drive the same forwardly and rearwardly along the guiding means.

Because the target is stored essentially lying down in its rest position and is moved from that position by translatory and swinging movements to its upright position, the target device need have only a small height. The device can rest directly upon the earth, without any pit work, and it requires only a minimum of measures for its protection from shooting damage.

The movement geometry which characterizes the target device of the invention results in low force being needed for the movement of the target member to the exposed position and permits a simple actuating mechanism to be employed.

According to a particular embodiment of the invention the housing or stand of the target device can be made as a box shaped unit with covered sides that constitute a protecting shell. With simple means it can be provided for that the shell, when the target is not being used, can be completely closed in to provide for secure storage of the target and the easily damaged apparatus that may be combined with it.

The invention is further explained hereinafter in connection with the accompanying drawings, which illustrate what is now regarded as a preferred embodiment of the invention and in which:

FIG. 3 is a fragmentary perspective view showing the front lower part of the target apparatus, wherein certain parts are omitted.

Figure 1:
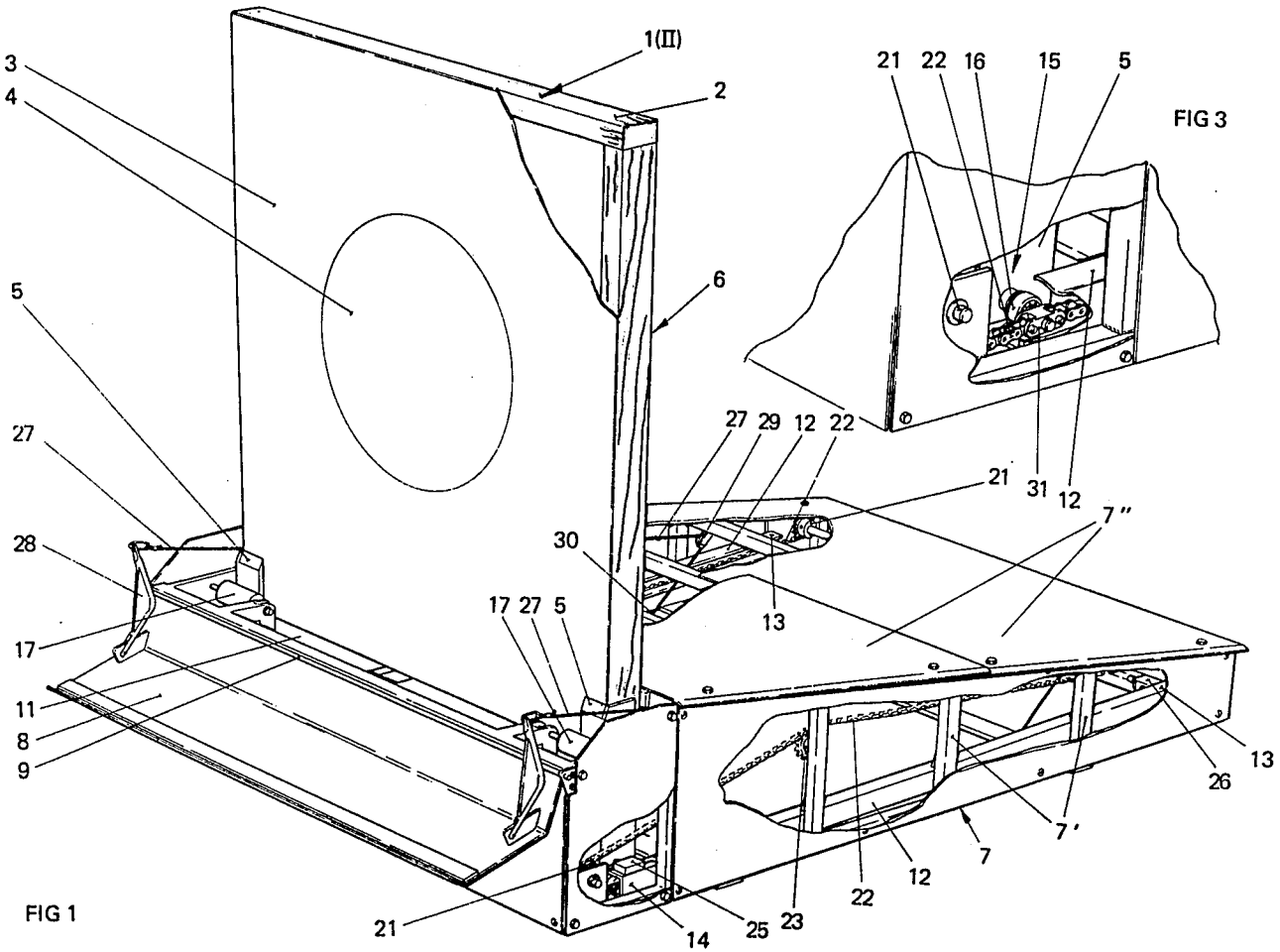
FIG. 1 is a perspective view of a target apparatus according to the invention, showing the target board in its exposed position for use.

In the drawings, 1 designates generally a shooting target which comprises a target board or target member that has a rectangular frame 2 covered by a cloth or sheet 3 on which is delineated a bullseye 4 or a target figure of other suitable type. When the target board is combined with a system for automatic hit scoring, the face of the target board towards which fire is directed need not include any further means for evaluating shooting results.

The target board is releasably fixed to a board holder 5 that is in the form of an upwardly opening receptacle in which the lower portion of the board frame 2 can be received and which is here shown as comprising oppositely located angle irons at the board's two lower corners, extending up along the lower portions of the vertical members of the board frame 2. The target board, together with the holder, forms a target unit 6 that is movably supported in a stand which is designated generally by 7 and which is in the form of a box-like housing. The target unit 6, and hence the target itself, is movable between a protected position, designated I, in which it is wholly enclosed by the stand or housing 7 and thereby protected against wind, weather and external influences, and a position of use, designated II, in which the target board projects vertically upward from the stand or housing 7 and is exposed so that it can be shot at.

As viewed from above, the stand 7 is rectangular, its length and width being somewhat greater than the height and width, respectively, of the target board. As viewed from either side, the stand 7, in the embodiment in which it is here illustrated, has substantially the form of a blunt wedge with the point directed in the shooting direction. It is built up of profile elements of which the drawing shows up-right side pieces 7' that comprise the side wall of the stand and give it the form of a right-angle parallel trapezoid. Transverse profile elements connect the side pieces with one another. At its top, sides and low rear end (which is to the right in the drawings), the stand is closed in by cover sheets 7''. The stand is intended to be placed on the ground, or upon a foundation directly behind a protecting wall (not shown), so that its front end wall (to the left in the drawing) can face toward the location from which shooting takes place. The shooting direction is thus the one designated by the arrow A in FIG. 2. If the stand is placed behind a protective wall, that wall should be at least as high as the stand and ought to be crowned with an armor plate so that the target device is protected from shot damage.

Figure 2:
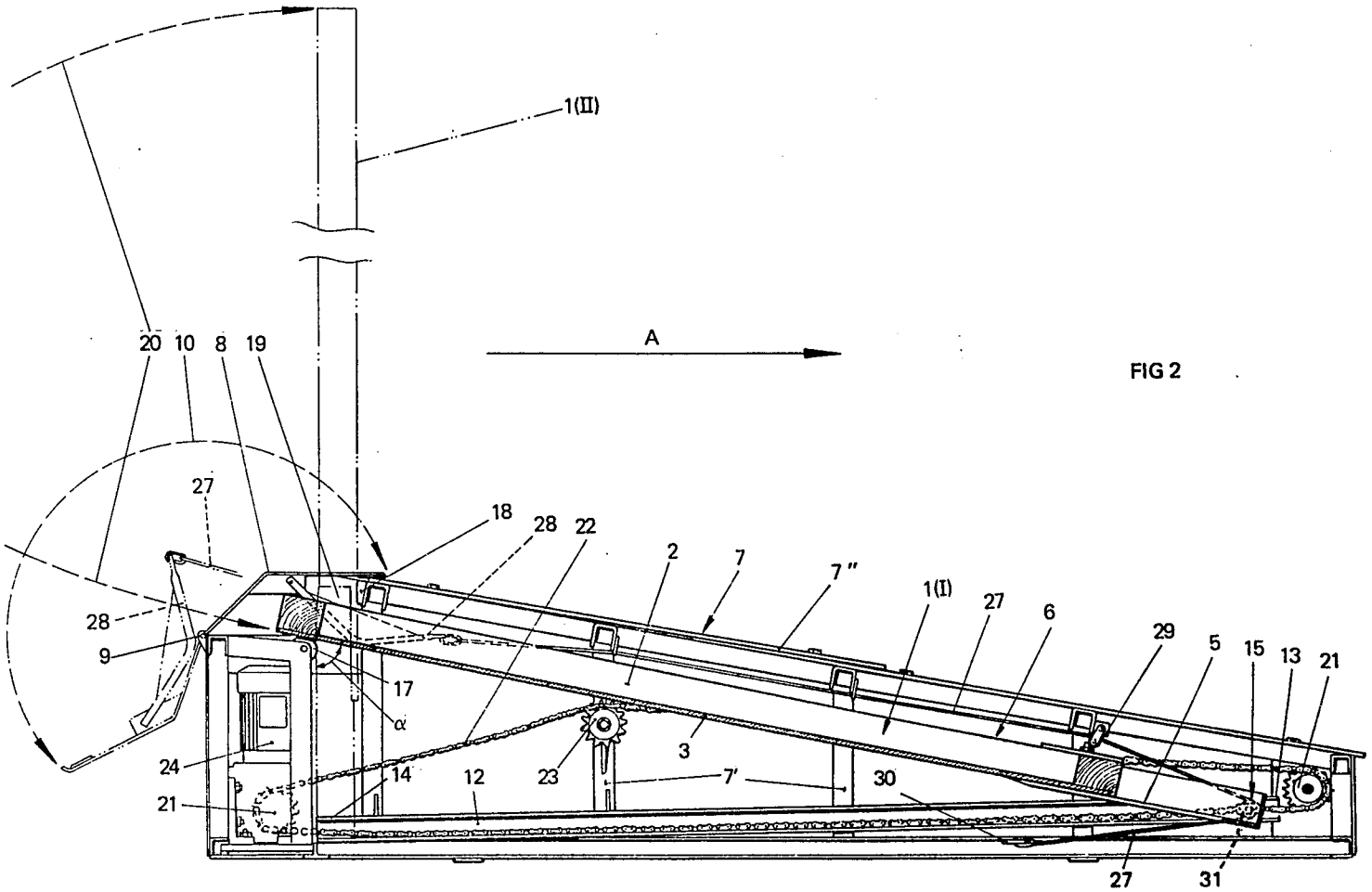
FIG. 2 is a view in section through the target apparatus, taken at right angles to the plane of the target board, which is shown in its protected position.

The vertical portion of the front end wall of the stand is covered with a sheet, in the same manner as the other walls of the stand, and along the upper edge of that sheet there extends a shaft 9 that supports a trapdoor 8 for swinging between a closed position, shown in full lines in FIG. 2, and an open position in which it is shown in FIG. 1. In the open position of the trapdoor 8, which it occupies when the target apparatus is being used, its edge remote from the shaft 9 lies below that shaft and in front of the front end wall of the stand, so that the trapdoor is then clear of an opening or gap 11 between the front edge of the top sheet 7'' and the top edge of the front wall. In the closed position of the trapdoor 8, which it occupies when the target board is in its protected position, the trapdoor extends across the gap or opening 11, with its edge remote from the shaft 9 resting on the top cover sheet 7'', and the trapdoor thus cooperates with the several covering sheets 7'' to close the housing completely.

When the target unit 6 is in its fully retracted or protected position II, shown in FIG. 2, the upper end portion of the target board 5 rests on a sliding support 17 that is located a short distance behind, and at about the level of, the shaft 9 upon which the trapdoor 8 is hinged. As here shown, the sliding support 17 comprises rollers, one near each side of the stand, that are freely rotatable on a common horizontal axis extending across the stand. As the target unit is moved between its positions I and II, the side members of the target board frame 2 rest on the support 17, while the lower edge portion of the target board is guided for substantially horizontal movement by an elongated guiding device 12 which is fixed in the stand and which cooperates with controlled means 15 on the target unit. Thus, when the target unit is in its protected position II, the lower edge of the target board is near the rear of the stand; and when it is in its erected operative position I, that lower edge is near the front of the stand.

As here shown, the fixed guiding device 12 in the stand comprises a pair of rails, each of U-shaped cross-section, one at each side of the stand, inwardly adjacent to the side wall. The rails 12, which are parallel to one another, extend through most of the length of the stand, so that the guiding device that they comprise has a front end 14 near the front wall of the stand, spaced beneath the sliding support 17, and has a rear end 13 near the rear end wall of the stand. The flanges of the two rails 12 project inwardly, and the distance between the rails is somewhat greater than the width of the target unit 6, so that it can be received between them. As here shown, the rails 12 are straight along their lengths and have a slight downward and forward inclination, but it will be understood that other, somewhat different arrangements of the guiding device are possible, as for example the rails could be curved upward or downward along their lengths.

The controlled means 15 on the target unit 6 that cooperates with the guiding device 12 comprises a pair of coaxial shafts, one fixed to each side of the target holder 5 and projecting sidewardly from it, upon each of which is journalled a freely rotatable roller 16 which is of such diameter as to be receivable between the flanges of the rail 12 at its side of the stand.

The movement geometry of the target unit 6 is determined by the sliding support 17 at the front end of the stand 7, in cooperation with the guiding device 12 that controls movement of the lower portion of the target unit. It will be apparent that as the controlled means 15 on the target unit is shifted forward or rearward along the guiding device 12, the target board rolls upon the support 17.

The stand 7 further has an abutment 18 at the side of the trapdoor opening 11 that is opposite the support 17; that is, the abutment 18 is at a distance above and to the rear of the sliding support 17, and the target board moves between its two positions I and II through the space or gap 11 between the sliding support 17 and the abutment 18, which gap is closed by the trapdoor 8 when the target unit is in its protected position II. The abutment 18, which can be provided by a profile element horizontally secured in the side wall of the stand, has for its purpose to steady and support the target unit in its upright position, which position the target unit occupies when the controlled means 15 at its lower portion is farthest forward in the guiding device 12.

A substantial advantage of the target apparatus according to the invention is that the stand 7 has a small height, which goes along with the fact that the target lies horizontally in its stored and protected position. It can be seen that the angle $\alpha$ (see FIG. 2), which the target board swings through in moving between its protected and exposed positions, should approach as closely as possible to 90°, because any decrease in the value of that angle involves a corresponding increase in the structural height of the target apparatus. In other words, it is essential that the vertical distance between the sliding support 17 and the front end 14 of the guiding device 12 be substantially less than the horizontal distance between the support 17 and the rear end 13 of the guiding device. In the illustrated embodiment, the angle $\alpha$ is 80°.

The target apparatus according to the invention is intended for being remotely actuated and is therefore, in this example, provided with an actuator that works upon the target unit's holder 5 to cause the controlled means 15 to execute forward and rearward sliding movements along the guiding device 12.

The actuator comprises a chain transmission that comprises two endless chains 22, one at each side of the stand, each trained over a pair of sprockets 21, one of which is located in front of the front end of the U-rail at its side of the stand and the other of which is located behind the rear end of that rail. The sprockets 21 for each chain 22 are further so located that they define a lower straight stretch of the chain that runs on the lower flange of its adjacent rail. In each chain 22 there is a specially formed link 31 which, as FIG. 3 shows, is connected to the shaft of the controlled means roller 16 at its side of the stand, which shaft projects out past the roller 16. The chain transmission also comprises a third sprocket 23 for each chain 22, located above the U-rail, which supports upper stretches of the chain to hold them upwardly clear of the rail.

The chain transmission is driven from an electric motor 24 that is coupled by means of a worm gear (not shown) or other suitable transmission to one or to both of the front sprockets 21. If the motor is coupled to only one of the front sprockets 21, then the rear sprockets 21 are connected by means of a transverse axle, so that both chains transfer power from the motor to both of the slides or controlled means 15 on the target unit.

For control of actuating movements there are limit switches 25, 26 which, as FIG. 1 shows, can be arranged at each end of the guiding device 12 for cooperation with the holder 5 on the target unit. The switch 25 stops the motor and terminates actuating movement when the target board arrives at its erected position of use, while the switch 26, in a corresponding manner, stops the actuator when the target board attains its protected position.

The trapdoor 8, which is of course kept closed when the target apparatus is not in use, is combined with a device that automatically closes it in the final part of target retraction. In the embodiment here shown, there are lines 27 for this, along each side wall of the stand. Each line is connected to the outer end of an arm 28 on the trapdoor that projects inwardly relative to it, and from that arm the line extends through the gap 11 and rearward under the upper cover sheet 7' of the stand, to a pulley 29 which is mounted at the rear of the side wall and around which the line is looped, thence forward to an anchor point 30 in the bottom of the stand. Each line 27 is engaged by the controlled means 15 on the target unit when the latter is in and near its retracted position, but it is not influenced by the target unit in its raised position. Thus, the line is of such length that when the target is in raised position it allows the trapdoor to hang down in front of the front end wall of the stand, where it is not exposed to be shot at. When the target unit is drawn back into the stand, the line is taken up by the controlled means 15 and is thus drawn rearward so that it swings the trapdoor upward until the trapdoor falls down over the opening 13. It will be apparent that the lines 27 provide, in effect, a lost motion connection between the trapdoor 8 and the controlled means 15.

The target apparatus is actuated in the following manner, wherein it is assumed that the target first occupies its protected position according to FIG. 2. When the motor 24 is energized by way of conventional electrical circuitry, the chain transmission is set in motion in the clockwise direction as seen in the drawings. The lower stretches of the chains 22, through the links 31, exert forward pull on the shafts of the controlled means 15, whereby the lower part of the target unit 6 is carried forward, that is, toward the left in the drawings, while the rollers 16 of the controlled means run in the U-rails 12. The target board has its front face at all times resting against the support rollers 17, whereby it is displaced upward and outward through the gap-like space 19. The target board strikes against the trapdoor 8 at the beginning of such movement, so that the trapdoor is lifted upward from its closed position. Because the lines 27 are released at their inner portions, owing to the forward movement of the target unit, the trapdoor can be carried further upward by the forwardly and upwardly moving target board until, of its own weight, it swings to its open position of FIG. 2 while the actuating movement continues.

With the target unit supported and controlled by the support 17 and the guide device 12, the free portion of the target board that is located outside of the stand continues its forward-upward swinging movement until it attains its upright position (II), that movement being shown by the broken curved line 20 in FIG. 2. When the target board reaches that position, the motor 24 is stopped by the front limit switch 25. Note that the erected target board is steadied in its upright position by the stopped chains 22, which lock the rollers 16 against forward and rearward movement, in cooperation with the support rollers 17, which engage the front face of the target board at a distance above the rollers 16, and with the abutments 18 which engage the rear face of the target board at a greater distance above the rollers 16.

When the target board, after use, is to be returned to its original position, the motor 24 is started anew, this time in the reverse of the direction that it ran for target erection, and the chains 22 are thus set in motion in the counter-clockwise direction, whereby the links 31, and with them the lower part of the target unit, are subjected to a pulling force directed towards the right in the drawings. The controlled means rollers 16 run as before in the guide device, but now move rearward in the stand, at the same time that the target board swings downward and passes in through the gap-like space 11. In the final stage of this retracting action the controlled means 15 engages the lines 27 and, as explained above, thus draws the trapdoor 8 to its closed position. When engagement takes place between the end of the target holder 5 and the limit switch 26, the current supply to the motor 24 is broken.

It is noteworthy that retraction of the target board into the stand turns the front face of the target board downward, and because of this there is no risk of its being soiled during storage. By reason of the board being wholly enclosed in the stand, there is further obtained a good protection for a fragile transmitter device for automatic hit position recording that may be present on or in association with the target board.

From the foregoing it will be seen that a target apparatus according to the invention is an advantageous alternative to the conventional elevator stand with raisable and lowerable carriages for target board movement, inasmuch as the apparatus of this invention facilitates to a high degree the setting up of shooting ranges, allowing such set-up to be accomplished with more flexibility than heretofore, with respect to both time and space; and at the same time the target arrangement of this invention facilitates operations on shooting ranges in that manual setting up is no longer needed for target handling or for marking.

What is claimed as the invention is:

1. A target device comprising a substantially board-like target member having opposite front and rear faces and opposite upper and lower ends and means providing for movement of the target member between a protected position and a position of use in which its front face is substantially upright and exposed to be shot at, said target device being characterized by:

A. means defining a housing having
  (1) opposite front and rear walls and
  (2) opposite side walls and wherein the target member can occupy a protected position between the side walls, extending substantially horizontally with its front face downward and its lower end near the rear wall;

B. elongated guiding means fixed in said housing, near the bottom thereof, extending from near said rear wall to near said front wall;

C. controlled means on the target member, near the lower end thereof, slidingly cooperable with said guiding means to confine the lower end of the target member to backward and forward movement in the housing; and D. sliding support means on the housing, adjacent to its front wall and at a level above the front end portion of said guiding means, with which said front face of the target member is at all times slidably engaged and which cooperates with said guiding means and said controlled means to constrain the target member to swing up to its position of use as its lower end is moved forward.

2. The target device of claim 1, further characterized by:

(1) said guiding means comprising a pair of rail means, one inwardly adjacent to each of said side walls, each having a pair of vertically opposing guiding surfaces; and (2) said controlled means comprising (a) a pair of coaxial horizontally extending shafts on the target member, each projecting towards one of said side walls, and (b) a roller freely rotatably journalled on each of said shafts and rollingly confined between said guiding surfaces of its adjacent rail means.

3. The target device of claim 1, further characterized by:

E. fixed means on said housing defining an abutment which is spaced to the rear of said sliding support means and is at a level above the front end portion of the guiding means, against which the rear face of the target member is engaged when the target member is in its position of use and which cooperates with said sliding support means to hold the target member upright.

4. The target device of claim 3, further characterized by:

F. actuator means in the housing, connected with said controlled means, for driving the latter forwardly and rearwardly along said guiding means to move the target member between its said positions.

5. The target device of claim 4 wherein said housing has a top wall that extends substantially from said fixed means to said rear wall and has an opening between said fixed means and said sliding support means through which the target member passes in moving between its said positions, further characterized by:

G. a trapdoor having a hinged connection to said housing to be swingable about a horizontal axis near the top of the front wall between
  (1) a closed position wherein the trapdoor extends across said opening to close the same and
  (2) an open position to which the trapdoor is pushed by the target member as the latter moves towards its position of use and in which the trapdoor is forwardly adjacent to said front wall.

6. The target device of claim 5, further characterized by:

H. means providing a lost motion connection between said trapdoor and said controlled means whereby movement of the target member to its protected position draws the trapdoor to its closed position and movement of the target member away from its protected position releases the trapdoor to be pushed open by the target member.

* * * * *